United States Patent [19]

Pappas

[11] 4,108,595

[45] Aug. 22, 1978

[54] METHOD FOR COLORING TEXTILE FABRICS AND FABRICS PRODUCED THEREFROM

[75] Inventor: Charles Pappas, Tiverton, R.I.

[73] Assignee: United Merchants and Manufacturers, Inc., New York, N.Y.

[21] Appl. No.: 718,450

[22] Filed: Aug. 26, 1976

Related U.S. Application Data

[63] Continuation of Ser. No. 575,465, May 7, 1975, abandoned.

[51] Int. Cl.[2] ..... D06P 7/00

[52] U.S. Cl. ..... 8/1 A; 8/1 XB; 8/14; 8/17; 8/149

[58] Field of Search ..... 8/14, 15, 149, 17

[56] References Cited

U.S. PATENT DOCUMENTS

| | | | |
|---|---|---|---|
| 651,599 | 1/1900 | Foster | 8/14 |
| 1,202,652 | 10/1916 | Bentley | 8/14 |
| 1,599,910 | 9/1926 | Mijer | 8/14 |
| 2,090,669 | 8/1937 | Dreyfus et al. | 8/14 |
| 2,157,119 | 5/1939 | Miles | 8/17 |
| 2,193,340 | 3/1940 | McConnell | 8/125 |
| 3,102,771 | 9/1963 | Neale | 8/14 |

FOREIGN PATENT DOCUMENTS

| | | | |
|---|---|---|---|
| 236,194 | 6/1926 | United Kingdom | 8/1 |

OTHER PUBLICATIONS

Redbook, Jun. 1970, pp. cover, 172, 173, 174.

*Primary Examiner*—Donald Levy
*Attorney, Agent, or Firm*—Michael A. Caputo

[57] ABSTRACT

A method for coloring fabrics with coloring agents producing unique decorative patterns thereon by pleating the fabric, distributing the coloring agents onto the pleated fabric, fixing the coloring agents to the fabric, and then unpleating the resulting colored fabric. Also disclosed is a method for producing a simulated printed effect upon a flocked fabric which has been flocked in a pre-determined design pattern and impregnated with a wetting agent prior to the said pleating step. Fabrics obtained by such methods are also described.

15 Claims, 1 Drawing Figure

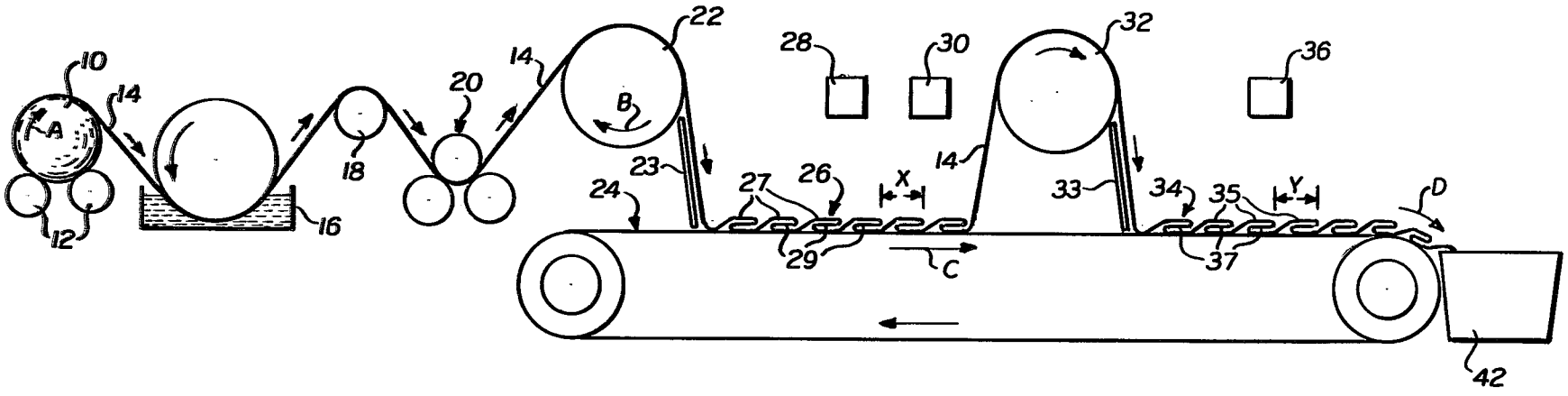
10
A
12
14
16
18
20
14
22
B
23
24
27
26
29
28
30
X
14
C
32
33
34
35
37
36
Y
D
42

METHOD FOR COLORING TEXTILE FABRICS AND FABRICS PRODUCED THEREFROM

RELATED APPLICATION

This application is a continuation of application Ser. No. 575,465, filed May 7, 1975, and now abandoned.

BACKGROUND OF THE INVENTION

1. Field of the Invention

This invention pertains to the field of coloring textile fabrics. More particularly, the present invention also concerns a method for dyeing textile fabrics which produces unique decorative patterns which give the appearance of having been printed, although no actual printing has taken place.

2. Description of the Prior Art

The art of dyeing textile fabrics is well known. Generally, textile fabrics are dyed by means of batch or continuous type dyeing methods. However, batch dyeing processes such as vat dyeing, jig dyeing, and the like, and continuous dyeing processes, such as spiral dyeing, thermosole dyeing, and the like, are generally limited and restricted in their dyeing capabilities to producing a fabric which has been dyed in only one color.

While it is possible to obtain fabrics dyed in a multitude of different colors with some of the dyeing processes available, it is difficult to obtain a high degree of color randomness.

Additionally, if a specific pre-determined design pattern is desired on a fabric, the above coloring methods generally become ineffective and one must usually resort to printing techniques such as roller printing, sublistatic printing, rotary stencil printing, and the like.

These printing methods, however, tend to require complicated, expensive equipment resulting in relatively high production costs.

Moreover, these printing techniques usually produce fabrics which contain only uniform and repetitive color schemes and patterns.

Further, in order to obtain a multi-colored fabric design by means of printing techniques, each and every color desired must be printed on the fabric. Thus, there is no blending of the coloring agents in a printing method which would cause the coloring agents to create a desired multitude of color and shade effects. Each shade and color desired must actually be applied to the roller or to the sublistatic paper in order for it to appear on the fabric.

SUMMARY OF THE INVENTION

Applicant has discovered a method for coloring textile fabrics which not only avoids substantially all of the above noted disadvantages inherent in both the batch and continuous dyeing processes, but additionally, is able to produce a simulated printed fabric without actually having to print, thereby avoiding the problems associated with the actual printing techniques described above.

In particular, the present invention is directed to a method for coloring a fabric which comprises temporarily pleating the fabric, distributing one or more coloring agents onto the pleated fabric, subjecting the pleated fabric with the coloring agents thereon to conventional fixation conditions used for the specific type of coloring agent being employed, and unpleating the fabric, thereby producing a colored fabric having a large range of unusual and highly desirable color and shade effects.

Additionally, applicant has discovered that if the fabric is impregnated with a wetting agent prior to the pleating step, the coloring agents subsequently applied to the fabric readily blend with each other and easily diffuse through and across the fabric, thereby creating a highly unique and desirable decorative effect containing a multitude of different colors and shades which are randomly distributed throughout the fabric.

Still further, applicant has discovered that by using the above noted process with a flocked fabric which has been flocked in a predetermined design pattern, wherein the flock and substrate to which the flock is adhered, are composed of different materials such that the coloring agent used dyes only the flock, and not the substrate, a novel and decorative simulated printed effect is obtained.

This printed effect is such that even actual printing techniques cannot duplicate the results. Particularly, the simulated printed effect obtained as a result of the present invention can produce design patterns in which the color variation and shade effects are infinite and non-repetitive due to the randomness and blending of the coloring agents as a result of the pre-wetting and pleating steps described above.

BRIEF DESCRIPTION OF DRAWINGS

The FIGURE is a schematic diagram of the present invention.

DESCRIPTION OF THE PREFERRED EMBODIMENT

Referring to the FIGURE, the process of the present invention may be carried out as follows:

Dry fabric 14 on roll 10 is unwound in the direction indicated by arrow A, utilizing feed rolls 12. The particular type of fabric used is not critical to the invention. However, the process is particularly advantageous for pile fabrics, such as, flocked fabrics, which have been flocked in a predetermined design pattern having flocked and unflocked areas. The use of such flocked fabrics enables a simulated printed effect to be obtained.

The art of producing flocked fabrics is old. Generally, a flock binder is applied to a substrate and then passed through a conventional flocking box wherein flock fibers are deposited onto the flock binder coated substrate. Thereafter, the binder is cured in order to be permanently set.

If it is desirable, the flock binder may be applied to the substrate in a predetermined design pattern by means of a stencil, roller, or the like. The end result of applying the binder in such a manner is a fabric containing flocked and unflocked areas thereby effecting a design pattern.

The production of flocked fabrics by such methods are well known in the art (see for example, U.S. Pat. No. 3,079,212, incorporated herein by reference).

In order to obtain the above noted simulated print effect, it is generally desirable that the flock of the flocked fabric be composed of a material other than that of the substrate, such that the coloring agents used, selectively dye either the flock or the substrate depending upon the particular coloring agent used.

Where a simulated print effect is not desired, any type of material suitable for dyeing may be used. These may consist of woven or non-woven fabrics, pile fabrics, knitted fabrics, and the like. Typically, suitable fabrics include acrylics, modacrylics, nylon, polyesters, acetates, wool, rayon, cotton, silk, mohair, natural and synthetic fibers, and blends thereof.

Fabric 14 is then conveyed to wetting tank 16, where the fabric is impregnated with a wetting agent.

Particularly, wetting the fabric allows for a high degree of diffusion to take place when the coloring agents are subsequently distributed onto the fabric. As a result of this greater diffusion capability, the coloring agents blend with each other more readily, and also penetrate the fabrics fibers to a much greater extent, such that a colored fabric having a large range of unusual and highly desirable color and shade effects is produced.

It appears that if the fabric is dry when the coloring agents are applied, though there is a certain amount of diffusion occurring, it is not of so great a magnitude as when the fabric is wet.

The diffusion occurring when the fabric is wet, is such that in the case of a pile fabric, for example, the coloring agents diffuse and penetrate the fabric along the length of the pile as well as across the pile to the surrounding areas. When using fabric other than pile fabrics, similar diffusion effects take place such that the coloring agents diffuse through the fabric as well as across the fabric.

It is this increased diffusion effect which also produces a higher degree of multi-tones and shade variation than that produced from a fabric which is not wetted. In particular, the various coloring agents distributed onto the fabric readily blend with each other, thereby producing the desired colorful effects. Thus, for example, if yellow and blue coloring agents were applied, the two would easily diffuse and blend with each other forming various shades of green. Other color blending schemes are well known in the art.

Generally, the wetting agent used can simply be water. Alternatively, the wetting agent can be any material which would be a suitable solvent for the particular type of coloring agent being used.

The selection of a suitable solvent for a particular coloring agent is well known in the art and can be readily determined by the skilled art worker.

Thus, for example, methanol could be used as the wetting agent where the coloring agent is a direct dye.

Where desired, a coloring agent may be added to the wetting agent itself, thereby imparting a slight tint to the fabric as it passes through the wetting tank. Generally, only enough coloring agent to make about a 0.05 to 0.2% and preferably about a 0.1% solution based on the total weight of solution is used in the wetting step in order to impart this slight tint. Of course, if it is desired, the strength of the coloring agent can be increased accordingly.

Although the wetting step is depicted in the FIGURE as being a tank in which the fabric is immersed and passed through, thereby impregnating the fabric, it is understood, of course, that any means for wetting the fabric would be satisfactory. The means for doing so is not critical to the present invention so long as it can effectively wet the fabric.

Different means of wetting a fabric are well known in the art and are easily selected by the skilled artisan. Typically, the fabric may be wetted by spraying the wetting agent onto the fabric. Other wetting means, such as, sprinkling, and streaming, and the like may also be used in the present invention.

Thereafter, fabric 14 passes over guide roll 18 and through nip rolls 20. The nip rolls 20 squeeze the excess wetting agent from the fabric such that approximately 30 to 80 percentage moisture, and preferably about 65 to 75 percentage moisture based on the weight of the dry fabric is retained.

Maintaining a control on a percentage moisture in the fabric enables the proper and desired diffusion effect to take place. Thus, if the fabric were too wet after it left the nip rolls, the coloring agents which would subsequently be applied would completely run and result in an undesirable, unappealing monotone due to the total and complete mixing of the said coloring agents. Additionally, it is economically desirable to keep the moisture content as low as possible so that the ultimate drying costs for the fabric is kept at a minimum. Moreover, keeping the moisture content as low as possible, also prevents the undesirable effect of diluting the strength of the coloring agents which are subsequently applied.

On the other hand, if fabric 14, upon leaving nip rolls 20, were not sufficiently wet, the desired increased diffusion effect could not be obtained, thereby reducing the desired multi-tone effect.

Although the FIGURE depicts nip rolls as the means for removing the excess wetting agent, the method of removing the excess wetting agent is not critical to the present invention. Accordingly, it would be well within the knowledge of the ordinary skilled art worker to substitute other methods for removing the excess wetting agent. Suitable methods could involve the use of vacuum extraction, heat, and the like.

Fabric 14 is then pleated by a novel pleating means comprising the combination of a roll 22, a guide 23, and an endless conveyor belt 24. Roll 22 will hereinafter be referred to as pleating roll 22.

Fabric 14 is fed onto pleating roll 22. Pleating roll 22 rotates at a given rate of speed in the direction indicated by arrow B. Fabric 14 is fed from pleating roll 22 onto endless conveyor 24 which moves in the direction indicated by arrow C, making use of guide 23.

The relative speeds of the pleating roll 22 and the conveyor belt 24 are such as to form pleats 26 in fabric 14 as it is picked up by conveyor 24. Thus, the relative linear speed of the conveyor belt is less than the linear speed of fabric travel on the pleating roll. This causes an excess of fabric 14 to be fed onto conveyor 24 due to the conveyor not being able to pick up the fabric as fast as it is being fed. The end result is that pleats 26 are formed on the conveyor.

The size of the pleating roll is not critical to the pleating means. Rather, it is the linear velocity of the pleating roll in relationship to the linear velocity of the conveyor belt which is important. Thus, it is understood that the larger the pleating roll diameter, the faster the linear velocity of the pleating roll will be for a given number of revolutions per minute.

The skilled artisan could easily vary the diameter size and the number of revolutions per minute of the pleating roll in relationship to the speed of the conveyor belt to obtain a desired combination of relative speeds in order to impart the desired number and size of pleats to the fabric.

Conveyor belt 24 is preferably grated, slotted, or the like, in order to prevent any buildup of coloring agents on the conveyor as it travels. Consequently, any excess coloring agent that is applied simply drips away from the fabric by means of the conveyor belt openings.

The rate that the conveyor belt travels at will generally depend upon such factors as the size and number of pleats desired, the type of fabric being colored, the strength of the coloring agent being used, the volume and rate of coloring agent application, and the like, all of which can easily be determined by the skilled art worker.

Generally, pleating roll 22 is run at a linear velocity of about 20 to 80 yards/minute, and preferably about 45 to 65 yards/minute. The corresponding relative speed of conveyor belt 24, will of course depend on the desired number and size of pleats. Typically, however, conveyor belt 24 will run at a speed of about 8 to 20 yards/minute and preferably about 12 to 16 yards/minute.

The number of pleats formed per yard is generally about 10 to 60 pleats/yard and preferably about 15 to 30 pleats/yard with the size of the pleats, as indicated by the letters "*x*" and "*y*" in the FIGURE, ranging from about ½ inch to 4 inches, and preferably about 2 inches in length.

It is understood, of course, that although the FIGURE depicts the novel combination of a roll, a guide, and a conveyor to form pleats 26, the means of forming the pleats is not critical to the invention so long as it can effectively form the desired pleats. Other types of pleating means which are well known in the art could also be used. Thus, for example, a swing plaiter an accordion plaiter, and the like, could also be used to form the required pleats.

This pleating step does not impart a permanent deformation to fabric 14. The resulting colored fabric does not bear any evidence that a pleating step was carried out during the coloring process. Indeed, the fabric is only temporarily pleated in order to obtain the desired multi-color effect, and is then unpleated at the end of the process. It is indeed possible, however, to permanently pleat the fabric where it is so desired, but that would generally constitute a separate and distinct step apart from the above pleating step used primarily for obtaining the novel multi-color effect of the present invention.

Generally, the pleats formed are such that each plate overlaps the one before it causing exposed areas 27 and unexposed areas 29 of fabric 14 to be formed, as shown in the drawing.

Accordingly, upon the subsequent application of coloring agent onto pleated fabric 14, it is the exposed areas 27 which primarily receive the coloring agents. Unexposed areas 29, although not directly receiving the coloring agents, may nevertheless be dyed somewhat due to the diffusion effect taking place and additionally, by some of the dye naturally flowing under the overlapped pleats.

Pleated fabric 14 is carried by conveyor 24 under a series of distributors 28 and 30, which distribute the coloring agents directly onto the fabric. The distributors may be so arranged as to distribute different coloring agents from each distributor respectively, thereby enabling a multi-toned and multi-colored fabric to be obtained. It is understood, of course, that any number of distributors may be used if additional coloring agents are desired.

The coloring agent is applied directly to the pleated fabric 14 without the use of expensive equipment such as rollers, dies, or transfer printers.

The type of distributor used is not critical to the present invention, so long as the distributor can effectively apply the coloring agent. Distributors of this type are well known in the art and can be easily selected by the skilled artisian. Typically, the distrbutors may consist of a sprinkling means, whereby the coloring agent is sprinkled onto the fabric. Alternatively, the distributor may comprise a spray means whereby the coloring agent is effectively sprayed onto the fabric. Other distributor means, such as, stream applicators, and the like, can also be used in the present invention.

The coloring agent may be distributed onto the fabric in a predetermined design pattern if desired. Accordingly, the distributors may be mounted so that they are capable of oscillating motion perpendicular to the face of the fabric or transverse to the direction of fabric travel in order to obtain a variation of shade depth and color.

Additionally, various shades and depths of color may also be obtained by varying the length of time that the coloring agent is applied to the fabric.

Alternatively, it may be desirable to distribute the coloring agents through a stencil which would impart a design pattern to the fabric.

As used herein the term "coloring agent" is meant to include coloring using dyestuffs, pigments, and other materials used in imparting colors to textile fabric.

Suitable coloring agents that may be used include disperse dyes, acid dyes, reactive dyes, cationic dyes, direct dyes, pigments, and the like.

It should be noted, however, that although pigments may be used in the present invention, they do not diffuse with each other. Setting that aside though, the application of the pigments onto the pleated fabric still produces a novel and desirable colored fabric.

The type of coloring agent used is entirely dependent upon the specific type of fabric material that is being employed; the particular combination of coloring agent and fabric being readily determined by the skilled art worker.

Thus, for example, cationic and disperse dyes may be used with fabric materials composed of acrylics, polyesters, modacrylics, nylon, acetates, and the like. On the other hand, reactive dyes are generally used with fabrics composed of, for example, cotton, rayon, wool, and the like. In addition, direct dyes may be used with cotton, rayon, and other direct dye receptive fabrics. Acid dyes may be used on wool, nylon, silk, and the other acid dye receptive fabrics.

The use of a specific coloring agent with an appropriate fabric material is described in detail in *The Physical Chemistry of Dyeing*, by Thomas Vickerstaff, incorporated herein by reference.

Suitable disperse dyes which can be used in the present invention include the classes of anthraquinone, monoazo, disazo, ketonimine dyes, and the like.

Typical pigments which can be used in the present invention include the classes of organic and inorganic pigments.

Suitable acid dyes include the classes of azo, trisazo, polyazo dyes, and the like.

Suitable reactive dyes include the classes of vinylsulphonyl, chlorotriazinyl, bisazo dyes, and the like.

Suitable direct dyes which can be used in the present invention include the classes of metalizedazo, monoazo, triphenylmethane dyes, and the like.

Suitable cationic dyes include the classes of methane, oxazine, triazine dyes, and the like.

Although it is possible to use the coloring agent without any additives or other components added to it, it may be desirable to add conventional dyeing auxiliaries to the coloring agent, such as, for example, solvents, diluents, leveling agents, softeners, and the like, in order to impart various physical and chemical properties to the dye and/or fabric.

The coloring agent is preferably applied in liquid form and most preferably as a solution of the coloring agent in an appropriate solvent. Typical solution concentrations are about 0.1 to 20 percent by weight of total solution and preferably about 2.5 to 15 percent.

When using a reactive dye, an alkali fixative agent, such as, for example, sodium carbonate, sodium bicarbonate, or the like is generally added to the dye in order to permanently fix it to the fabric.

Applicant has found that an increase in depth of dye impregnation into the fabric is obtained where the alkali fixative agent is mixed with the fiber reactive dye prior to the dye being distributed onto the fabric. This initial mixing of reactive dye and fixative agent causes the components to begin reacting immediately upon mixing.

As a result of this increased dye impregnation, the dyes are able to penetrate the fabric easily and rapidly, thereby allowing for the fiber reactive dyes to readily blend with each other resulting in the desired multicolor and shade effects.

The amount and concentration of alkali solution to be used is well known in the art.

Generally, the amount of alkali added to the coloring agent is 1 part by volume of alkali to 4 parts by volume of coloring agent wherein the solids content of the alkali to the coloring agent is 1 to 2 by weight of solids. Thus, if 100 grams of a coloring agent were used, 50 grams of an alkali would be needed. The 100 grams of coloring agent would then be dissolved in a volume four times as great as that of the alkali. Therefore, if the 100 grams of coloring agent were dissolved in 4 gallons of water, the 50 grams of alkali would be dissolved in 1 gallon of water. The resulting solutions would then be the proper combination of alkali and coloring agent.

It is desirable to mix the alkali agent with the fiber reactive dye just prior to its being applied to the fabric. Generally, the solution of dye and alkali should be applied to the fabric within 5 to 10 minutes, and preferably within 3 to 7 minutes of mixing.

As was discussed earlier, it is well known in the art that certain types of dyes will dye certain types of fabrics, and that other types of dyes will similarly dye other types of fabric. Accordingly, disperse dyes and cationic dyes will dye nylon, acrylics, polyesters, and other synthetic fabrics, but, will not dye cellulosic fabrics such as rayon, cotton, and the like. Direct dyes and reactive dyes, on the other hand, will dye cellulosic fabrics, but will not dye synthetic ones.

Consequently, if fabric 14 were to consist of two different textile compositions, such as, rayon and polyester, only the rayon would be dyed if a reactive dye were used as a coloring agent, leaving the non-susceptible polyester portion of the fabric undyed.

This selective dyeing principle is the basis for imparting the novel printed effect discussed earlier.

Thus, where fabric 14 is a flocked fabric which has been flocked in a preselected design pattern, such as was discussed earlier, and where the flock is composed of cotton and the substrate is composed of nylon, a simulated print effect can be obtained by using reactive dyes as the coloring agents. Particularly, the reactive dyes will selectively dye only the flocked cotton areas and leave the nylon substrate undyed.

The combination of using such a fabric which is then pleated and subjected to the proper coloring agents, produces a non-repetitive, multi-colored, multi-shaded printed effect without the use of expensive printing equipment.

The flocked fabric may, of course, be composed of polyester flock and a rayon substrate which would then require a coloring agent such as a disperse dye to selectively dye the flock without also dyeing the substrate.

Alternatively, it may also be possible to leave the flock undyed and only dye the substrate with the use of an appropriate coloring agent. Other modifications and variations can easily be made by the skilled art worker.

Referring again to the drawing, after dyeing, fabric 14 may then be subjected to fixation conditions, or alternatively, as another embodiment of the present invention, fabric 14 may be carried onto second pleating roll 32 and refed onto conveyor 24 making use of guide 33.

By virtue of the relationship of the speed of pleating roll 32 to the speed of conveyor 24, the fabric 14 is straightened out and then repleated to form new pleats 34.

The purpose of this optional repleating embodiment is to expose different areas of the fabric to another coloring agent distributor 36 which may distribute a coloring agent of preferably yet another color onto the fabric. This results in an increase in multi-color effect, and also provides, where it is desired, maximum dyeing coverage of the fabric surface area.

Particularly, pleats 34 are generally formed so as to produce exposed areas 35 which preferably were previously unexposed areas 29 in the first pleating operation and unexposed areas 37 which preferably were previously exposed areas 27 in the first pleating operation, respectively.

Generally, it is desirable to keep the size of the pleats in the subsequent pleating steps approximately equal in size to the pleats formed in the first pleating step. Accordingly, length "*x*" will usually be equal to length "*y*", as indicated in the drawing.

The coloring agent distributor 36 and the pleating roll 32 are similar to distributors 28 and 30, and pleating roll 22, respectively, used in the first pleating operation. Accordingly, all of the above comments made with respect to distributors 28 and 30, and pleating roll 22 are also applicable to distributor 36 and pleating roll 32, respectively.

It is understood, of course, that any number of coloring agent distributors may be used in the pleating and repleating steps. Additionally, it is also possible to provide subseqent repleating steps if a high concentration of color is desired.

After the last pleating and coloring step, fabric 14 is then subjected to fixation conditions in order to permanently fix the coloring agents to the fabric.

Where the coloring agents used are fiber reactive dyes, it is desirable to allow the reactive dyes to fix onto the fabric in a static and moist atmosphere at room temperature. This type of fixation is generally known in the art as wet fixation and allows for maximum diffusion of the fiber reactive dyes into the fabric.

Generally, as shown in the FIGURE, when wet fixation is desired, fabric 14 while still in the pleated and wet state, may be conveyed in the direction indicated by arrow D into holding box 42. In holding box 42, a static and moist atmosphere is maintained for approximately 2 hours in order to wet fix the reactive dye. Subsequently, the fabric may be unpleated and washed and dried in the conventional manner.

Alternatively, when coloring agents other than fiber reactive dyes are used, fabric 14 may be subjected to other fixation techniques depending upon the specific coloring agent being used. Such other fixation techniques include steam fixation, solvent vapor fixation, gaseous ammonia fixation, heat, or the like. Such conventional fixation treatments are discussed in the aforementioned reference, *The Physical Chemistry of Dyeing,* by Thomas Vickerstaff.

After fixing, the fabric is washed and dried in the conventional manner.

The process described heretofore is a preferred embodiment of the present invention. Some of the process steps described are not critical to the present invention, although they are preferred steps.

Thus, the steps of wetting the fabric initially and subsequently passing the fabric through nip rolls are not critical to the present invention. These steps are optional and involve another embodiment of the present invention.

As discussed earlier, wetting the fabric allows for a high degree of diffusion to take place when the coloring agents are applied to the fabric. The diffusion occurring when the fabric is wet is much greater than when the fabric is dry, resulting in a wider variety of colors, shades and tones than would appear with a dry fabric.

Additionally, when using the pleating roll and conveyor belt combination to form the desired pleats, it is desirable to keep the fabric wet in order to facilitate the formation of the pleats.

Similarly, the pre-mixing of the fixative agent with the fiber reactive dye just prior to its application onto the fabric is yet another embodiment of the present invention.

This pre-mixing step is optional and the invention would work satisfactory without this step. However, this step, when performed, does improve dye impregnations into the fabric, as was discussed earlier.

The following examples illustrate my invention:

EXAMPLE 1

A 100% polyester ninon substrate having rayon flock adhered to it in a preselcted design pattern was dyed in accordance with the present invention. The fabric was first impregnated with water by passing it through a tank filled with water and then passed through nip rolls to provide the resulting fabric with 65 percent moisture content.

The wet fabric was then pleated using a pleating roll-conveyor belt combination wherein the pleating roll was rotated at a linear velocity of 45 yarsds/minute and the conveyor belt was moved at 12 yards/minute. The resulting pleats formed were approximately 2 inches long. The number of pleats formed per yard was approximately 25 pleats/yard. The pleated fabric was then dyed by spraying fiber reactive dyes onto the fabric using five distributors wherein each contained a 13 thousandths of an inch spray nozzle capable of delivering 140 cc/minute per nozzle. The dyes used were procion yellow MX-4G having CU# Reactive Yellow 22 and procion orange MX-2R having CI# Reactive Orange 4 wherein each dye had 1 part by volume of sodium hydroxide to 4 parts by volume of dye already mixed with it. The alkali was added to the coloring agents 3 minutes before it was applied to the fabric.

The fabric was then unpleated and repleated with a second pleating roll such that the number and size of the pleats formed were the same as in the first pleating step. Additionally, the second series of pleats were formed such that the previously unexposed surfaces were now exposed and vice versa. Subsequently, procion red MX-5B having CI# Reactive Red 2 was applied to the repleated fabric by spraying with 5 distributors wherein each distributor contained an 11 thousandths of an inch spray nozzle capable of delivering 110 cc/minute per nozzle. The fabric was then placed in a holding box where it was wet fixed for 2 hours at a constant relative humidity and at room temperature. After fixing, the fabric was washed and dried.

The resulting fabric contained a simulated print effect where the rayon flock was dyed in a multitude of colors and variation of shades, and the polyester ninon substrate remained colorless.

EXAMPLE 2

Dyeing was effected in a manner analogous to that described in Example 1 with the exception that the fabric used was a flocked fabric having a substrate composed of cotton and flock composed of nylon which had been flocked over the entire substrate surface.

The dyes used were Bucron Yellow 3G-NS having CI# Disperse Yellow 64, Amiciron Red BM having CI# Disperse Red 60, and Calcosperse Blude BG having CU# Disperse Blue 60. The flock of the resulting fabric was multi-colored while the substrate remained colorless.

EXAMPLE 3

Dyeing was effected in a manner similar to that described in Example 1 with the exception that the fabric used was an acrylic sliver knit composed of 70% acrylic pile and 30% polyester backing. Additionally, the prewetting step was not included.

The coloring agents used were Amocron Red BM having CI# Disperse Red 60 and Bucron Yellow 3G-NS having CI# Disperse Yellow 64.

The fabric was fixed by thermosoling at 420° F for 120 seconds.

Both the flock and substrate of the resulting fabric contained a multitude of various colors and shades.

EXAMPLE 4

A 100% rayon woven fabric was dyed by first prewetting the fabric with a 0.1% solution of Erie yellow Y, CI# Direct Yellow 12 and water. The wetness of the rayon fabric was then brought down to 50% by vacuum abstraction and was subsequently pleated by means of a swing plaiter. Amonil Orange SE having CI# Direct Orange 26 was then applied to the pleated fabric by a plurality of streams.

The coloring agents were then fixed to the fabric by means of steam. The resulting fabric contained unusual and aesthetic colorful effects.

Variations and modifications may, of course, be made without departing from the spirit and scope of the present invention.

Having thus described my invention, what I desire to secure by Letters Patent is:

What is claimed is:

1. A method for using a dye to simulate a printed effect in a flocked fabric composed of a substrate, which is not receptive to the dye, and a flock, which is receptive to the dye and is present in a predetermined design pattern, comprising:

(a) pleating the flocked fabric;
(b) distributing said dye onto the pleated fabric such that only the flock, which is receptive to the dye, is dyed;
(c) unpleating the flocked fabric; and
(d) subjecting the flocked fabric to fixation conditions to permanently fix the dye to the flock.

2. The method of claim 1 wherein the flocked fabric is pleated by means of a roll, a conveyor belt, and a guide.

3. The method of claim 1 wherein the dye is distributed onto the pleated flocked fabric in a predetermined design pattern.

4. The method of claim 1 wherein the dye is distributed onto the pleated flocked fabric in a random manner.

5. The method of claim 1 wherein the dye is distributed by spraying, sprinkling, or allowing the dye to flow in a plurality of streams.

6. The method of claim 1 wherein the dye is selected from the group consisting of disperse dyes, acid dyes, reactive dyes, cationic dyes and direct dyes.

7. The method of claim 1 wherein the pleated and dyed flocked fabric, prior to fixation, is (a) unpleated;
(b) repleated such that different areas of the fabric including different flocked areas are exposed; and
(c) colored by distributing one or more coloring agents onto the repleated fabric.

8. The method of claim 1 wherein the flock is composed of rayon, the substrate is composed of polyester, and the dye used is a fiber reactive dye such that only the rayon is dyed.

9. The method of claim 8 wherein a suitable reacting agent is mixed with the fiber reactive dye prior to distributing the dye onto the fabric.

10. The method of claim 1 wherein prior to pleating the fabric, the fabric is impregnated with a wetting agent.

11. The method of claim 10 wherein the wetting agent is a suitable solvent for the specific coloring agent used.

12. The method of claim 10 wherein the wetting agent is water.

13. The method of claim 10 wherein the wetting agent contains a coloring agent.

14. A method for applying one or more coloring agents to a flock printed fabric composed of a substrate, which is not receptive to the coloring agents, and a flock, which is receptive to the coloring agents, comprising:

(a) impregnating the fabric with a wetting agent;
(b) pleating the fabric including the flocked areas;
(c) distributing one or more of said coloring agents onto the pleated fabric;
(d) unpleating the fabric;
(e) repleating the fabric including the flocked areas so that different areas of the fabric are exposed;
(f) distributing one or more of said coloring agents onto the repleated fabric; and
(g) subjecting the fabric to fixation conditions to permanently fix the coloring agent to the fabric.

15. A method for simulating a printed effect in a flocked fabric composed of a polyester substrate which has been flocked with rayon flock in a predetermined design pattern comprising:

(a) impregnating the flocked fabric with water;
(b) pleating the flocked fabric;
(c) distributing one or more fiber reactive dyes onto the pleated fabric such that only the rayon flock which is susceptible to the fiber reactive dye, is dyed;
(d) unpleating the flocked fabric;
(e) repleating the flocked fabric so that different areas of the fabric are exposed;
(f) distributing one or more fiber reactive dyes onto the repleated flocked fabric; and
(g) wet fixing the flocked fabric to permanently fix the fiber reactive dyes to the rayon flock.

* * * * *